US005412549A

United States Patent [19]

Blakely

[11] Patent Number: 5,412,549

[45] Date of Patent: May 2, 1995

[54] ELECTRICAL LIGHTING DEVICE

[76] Inventor: Mark K. Blakely, 2612 Geneseo Rd., Avon, N.Y. 14414

[21] Appl. No.: 101,650

[22] Filed: Aug. 4, 1993

[51] Int. Cl.[6] ..... F21V 31/02

[52] U.S. Cl. ..... 362/218; 362/267; 362/310; 362/158; 362/225; 362/223; 362/294

[58] Field of Search ..... 362/310, 101, 267, 260, 362/217, 225, 158, 294, 218, 223; 119/245, 246, 247, 376

[56] References Cited

U.S. PATENT DOCUMENTS

| | | | |
|---|---|---|---|
| 629,291 | 7/1899 | Hall, Jr. et al. | 362/267 |
| 2,104,762 | 1/1938 | Riner | 362/158 |
| 2,704,038 | 3/1956 | Carrie | 362/267 |
| 3,864,562 | 2/1975 | Hawkins | 362/101 |
| 4,100,593 | 7/1978 | Bond | 362/267 |
| 4,249,234 | 2/1981 | Park et al. | 362/228 |
| 4,268,894 | 5/1981 | Bartunek et al. | 362/158 |
| 4,394,716 | 7/1983 | Campagna et al. | 362/158 |
| 4,553,194 | 11/1985 | Bailey | 362/267 |
| 4,598,346 | 7/1986 | Bodde | 362/267 |
| 4,617,615 | 10/1986 | Eychaner | 362/267 X |
| 4,779,174 | 10/1988 | Staten et al. | 362/158 |
| 5,088,015 | 2/1992 | Baggio et al. | 362/260 X |
| 5,167,445 | 12/1992 | Linnenkamp et al. | 362/260 X |

*Primary Examiner*—Ira S. Lazarus
*Assistant Examiner*—Thomas M. Sember
*Attorney, Agent, or Firm*—Nixon, Hargrave, Devans & Doyle

[57] ABSTRACT

A lighting device comprises a waterproof housing in the form of an elongated flattened tube of substantially uniform transverse cross section that encloses a plurality of parallel tubular fluorescent lamps positioned lengthwise in the housing. The housing has two substantially parallel face walls of relatively large area and two connecting walls of relatively small area, at least one of the two substantially parallel face walls being transparent. The housing further comprises a watertight closed end and an open end having a rim that corresponds to the cross section of the housing at that end. A removable watertight cap covers the open end of the housing, the underside of the cap having a circumferential groove corresponding to the rim of the housing, and a gasket is positioned in the groove. The cross section of the housing is elongated transversely and is indented at each end thereof to form a lengthwise groove in the outer surface of each of the connecting walls of the housing. The grooves extend outside of the housing for the entire length of the housing. A rod is positioned in each of the grooves outside of the housing; each rod being fixed to the closed end of the housing and being of length sufficient to extend above the open end of the housing and through the cap positioned on the open end. Means such as a threaded nut at the end of each rod presses the gasket in the groove of the cap into watertight engagement with the rim of the housing. A flexible tube, attached in watertight connection to an opening in the cap, encloses an electrical conductor which is connected to circuitry for the fluorescent lamps in the housing and is connectable to a source of low voltage direct current. The tube vents the interior of the housing to the atmosphere.

7 Claims, 3 Drawing Sheets

ELECTRICAL LIGHTING DEVICE

FIELD OF THE INVENTION

This invention relates to an electrical lighting device and, more particularly, to such a device that can function when submerged in water.

BACKGROUND

Water-submersible lighting devices are useful for a number of purposes and are especially useful for underwater lighting of swimming pools. Problems, however, include the difficulty and expense of installation, the difficulty of achieving watertight closure of the device so that short circuits or corrosion are avoided, the risk of electrical shock when substantial voltage is applied to the device, and the difficulty of replacing burned-out lamps. For example, some known underwater lights for swimming pools are permanently fixed below water level and are powered by residential power. Such lights require draining of water from the pool to replace a burned-out lamp. They also present the danger of high voltage electrical shock.

BRIEF SUMMARY OF THE INVENTION

The device of the present invention provides an improvement over existing submersible lighting devices by providing effective low voltage means for energy-efficient underwater illumination, for exclusion of water from the electrical elements, for ease of installation, and for adjustable positioning of the device in a pool.

The lighting device comprises a waterproof housing in the form of an elongated flattened tube of substantially uniform elongated transverse cross section. Within the housing tubular fluorescent lamps are positioned lengthwise in parallel relationship to each other. The housing comprises two substantially parallel face walls of relatively large area and two connecting walls of relatively small area, at least one of the two substantially parallel face walls being transparent. The housing further comprises a watertight closed end and an open end having a rim that corresponds to the cross section of the housing at that end. A watertight cap is positioned on the rim of the housing. The cap is in the form of an inverted cup having a dependent circumferential wall of elongated cross section, its inner circumference being sufficiently large to enclose the upper end of the housing. Within and on the under surface of the cap is a continuous channel in which is positioned a resilient gasket material which is coextensive with the rim of the housing and means are provided for pressing the cap and gasket material into watertight engagement with said rim.

In a preferred embodiment, the elongated transverse cross section of the housing is indented at each end thereof to form a groove extending the entire length of the housing on the outside of each connecting wall. A rod is positioned in each of the grooves outside of the housing, each rod being fixed to the closed end of the housing and being of length sufficient to extend above the open end of the housing and through the cap positioned on the open end. Means are attached to the end of each rod for pressing the cap into watertight engagement with the rim of the housing.

In a preferred embodiment, a watertight flexible tube is attached to an opening in the cap and encloses an electrical conductor which is connected at one end to circuitry which drives fluorescent lamps and at its other end to a source of low voltage direct current. Preferably, the flexible tube also encloses a semi-rigid but bendable supporting means, such as a metal rod, which extends from about the position of the cap a sufficient distance toward the remote end of the tube to permit bending of the rod and the enclosing tube into the form of a supporting hook. In another preferred embodiment, an elongated metal plate is positioned between the fluorescent lamps and a face wall of the housing to reduce the buoyancy of the lighting device.

BRIEF DESCRIPTION OF THE DRAWINGS

The invention will be further described by reference to the drawings, of which.

DETAILED DESCRIPTION

Figure 1:
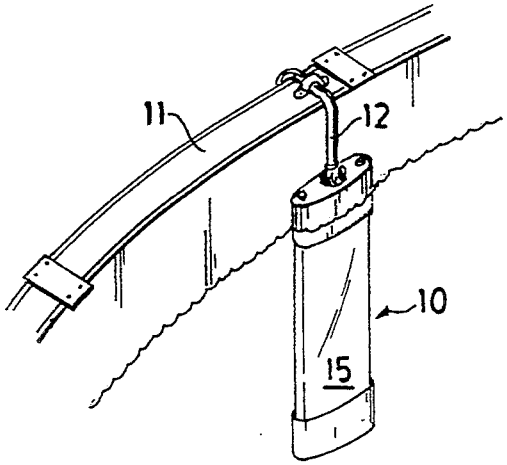
FIGS. 1 and 2 are perspective views of a lighting device of the invention attached to an above ground and an in-ground pool, respectively.
Figure 2:
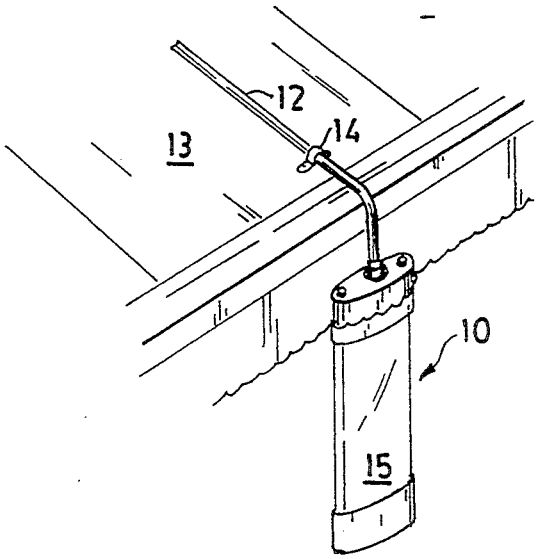

As shown in FIG. 1, an electrical lighting device 10 of the invention is supported on the wall 11 of an above ground swimming pool by bending a steel supporting rod (not shown) within the flexible tube 12 to form a hook. A similar support is shown in FIG. 2 for an in-ground pool where the tube 12 rests on the ground level 13, preferably with a clamp 14 holding the unit in place. FIGS. 1 and 2 show that the device 10 includes a light chamber or housing 15 in the form of an elongated flattened tube.

Figure 3:
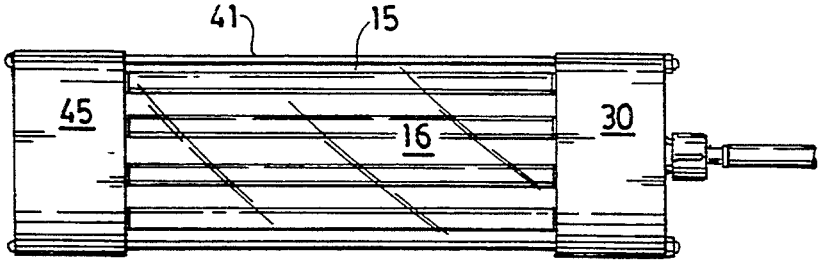
FIGS. 3, 4 and 5 are front, side and rear elevation views, respectively, of a device of the invention.
Figure 4:
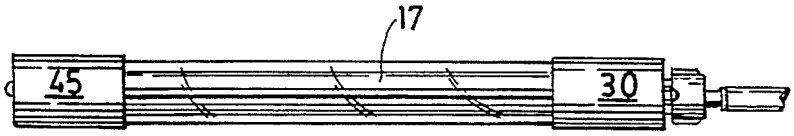
Figure 5:
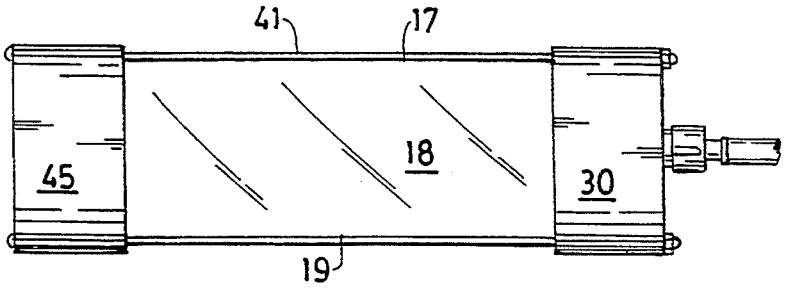

As shown in FIGS. 3, 4 and 5, the housing 15 has a face wall 16 of relatively large area and connecting wall 17 of smaller area. Substantially parallel to face wall 16 is a rear face wall 18, and substantially parallel to connecting wall 17 is a connecting wall 19. At least the face wall 16 of housing 15 is transparent. A preferred form of housing 15 is an extruded flattened tube of a transparent thermo plastic such as polycarbonate, polyvinyl chloride or polypropylene, in which all sides of the housing can be transparent.

Figure 6:
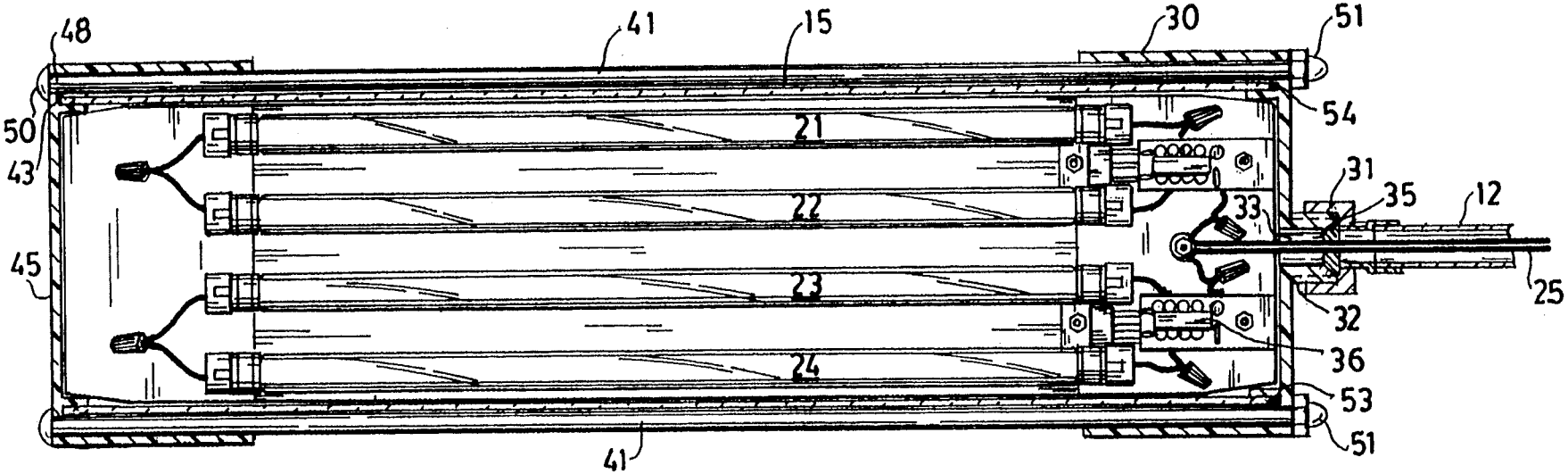
FIGS. 6 and 7 are sectional elevation and side views, respectively, of a device of the invention.
Figure 7:
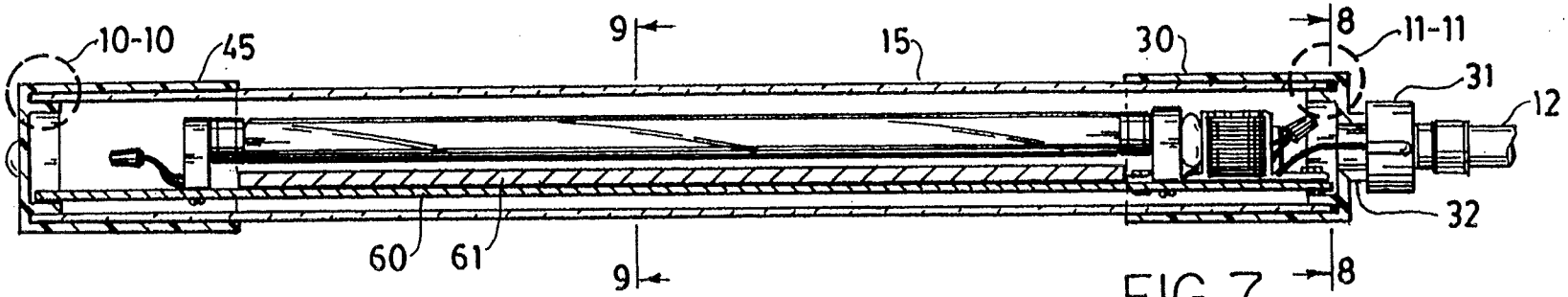

FIGS. 6 and 7 are sectional views of the device 10 and show fluorescent lamps 21, 22, 23 and 24 enclosed within the housing 15. As shown in the drawings, the lamps are positioned lengthwise in the housing in parallel relationship to each other and are mounted on a circuit board with electrical circuitry of conventional design which connects the lamps to electrical conductors 25. Although employing known electrical and electronic components, the components mounted on the circuit board are arranged compactly to permit insertion and removal of the fluorescent lamps through the relatively small area of the upper end of housing 15. The conductors 25 extend into and are enclosed within a watertight flexible tube 12. The latter, preferably, is removably connected to the top cap 30 of device 10 by a screw fitting 31 that is threaded to a nipple 32 which is integrally attached to the upper surface of top cap 30 and surrounds the opening 33 in the top cap. A gasket 35 provides a watertight seal between the tube 12 and the entrance to the top cap 30.

The electrical conductors 25 are connected at one end to the lamp circuitry, which includes the fluorescent lamp drivers 36 as shown, and pass through the opening 33 in the top cap 30, then into the flexible tube 12. At their other ends they are provided with clamps, or other means not shown, for electrical attachment to a 12-volt battery or other suitable power source for the fluorescent lamps.

Figure 12:
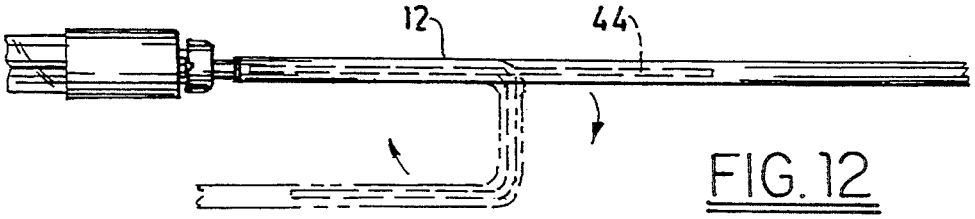
FIG. 12 is a view in detail of the flexible tube and enclosed bendable supporting means.

In FIG. 12 is depicted a bendable metal rod 44, which can be bent to any desired hook shape for hanging the lighting device as shown in FIGS. 1 and 2. In this function, tube 12 and bendable rod 44 form a means liar supporting the lighting device.

The lighting device of the present invention provides illumination comparable to that provided by conventional incandescent pool lights while using 20–25% of the electrical energy required by conventional lights. Efficiency is further enhanced by the use of "Daylight" fluorescent lamps, which have a color temperature of 6300° K. and a cumulative wavelength much shorter than any other lamp designed to emit visible light. This allows more efficient penetration of the water by the light, without the reflection or "beaming" from suspended particles typical of conventional pool lights. A benefit of this efficiently diffused light is that it provides more attractive, even illumination of the pool and the water. Furthermore, without intense brightness near the light source, flying insects are less attracted to the pool than they would be by less diffuse lighting. In addition, this kind of fluorescent illumination increases the safety of nighttime swimming because all objects in the pool are illuminated and the pool edge, steps and ladder are clearly defined.

A disadvantage of prior an devices relates to the reliance on elaborate and critical sealing requirements of adjoined pans. Mating surfaces typically extend around the entire circumference of the pool light, and joining techniques typically employ a multitude of fasteners arranged such that each is a potential source of leakage. Consequently, the simple act of changing batteries or a bulb can lead to failure of the device.

An overall advantage of the novel lighting device is that it provides a large or maximum area of illumination in combination with a small or minimal area that must be sealed against leakage.

In the lighting device of the invention a simple and effective water seal is provided. The mating area of adjoining parts is kept to a minimum. The gasket is recessed in the top end cap to protect it from damage or misalignment. Cap nuts that secure the parts are located outside of the gasketed area of the extruded light chamber, and do not need to be additionally gasketed.

Further leakage protection is accomplished by the positioning of the gasketed area at the top end of the device where it can be positioned at or slightly above the surface of the water in the pool, where hydrostatic pressure is minimal. The light chamber need be opened only infrequently to change a bulb and in the preferred embodiment this can be accomplished quickly because it requires release of only two fasteners.

Another factor which can lead to gasket failure is the effect of thermal expansion and contraction of air within the light chamber. A sealed housing which is used in a pool environment and exposed to the extremes of hot sunlight and cool nights is prone to the failure of seals. High internal pressure can be created by rising temperatures, which can lead to disruption of the seal in a warm gasketed area. In a cool environment, an internal vacuum is created which can draw water in through the gasketed area. This problem is compounded by the damaging effects of heat from incandescent bulbs and ultraviolet sunlight that can degrade gaskets, particularly in transparent housings, thus destroying elasticity and sealing properties. The gasket in the device of my invention is protected from ultraviolet light by locating it within an opaque end cap.

The formable hanger tube embodied in my device provides venting such that the light chamber always remains at atmospheric pressure. This tube, which can enclose an internal wire or rod that is formable by bending, also allows for adjustable installation of the lighting device at the recommended position at or slightly above the water surface.

A valuable advantage of the novel structure of the lighting device of the present invention is its ease of manufacture. The light chamber or housing can be made inexpensively simply by extruding a tube of transparent plastic through a die having the shape of the desired housing cross section. This tube can be cut to any length, allowing for utilization with two or three sets of parallel fluorescent lamps. In addition, the manufacture can be simplified by using top and bottom caps 30 and 45 of the same structure. They would differ only in that bottom cap 45 is permanently sealed to housing 15 while top cap 30 is removable, and nipple 32 is blanked and its opening in the cap is sealed during production of bottom cap 45.

A problem in the prior art has been the matter of buoyancy of a water-submersible light, which requires the incorporation of substantial ballast within the device. The trim design of my light, which minimizes water displacement, utilizes a steel ballast plate attached to the current board as a structural and functional component of the light design. This weight is located within the watertight housing and thus does not need additional protection from water and chlorine, whose effects limit the material that can be used to counteract buoyancy. Furthermore, the flat plate can be painted gloss white and serve to reflect, diffuse, and provide directionality to the light.

In commercial applications, the light chamber can be mounted fully underwater in a wet niche and brought to the surface for servicing by the flexible tube connected to a conduit stub located in the niche.

Although my light is intended for use primarily for swimming pools, it can be employed to illuminate campsites, backyard worksites, night fishing or diving or in any other situation where a compact, waterproof, portable lighting device is required.

Figure 10:
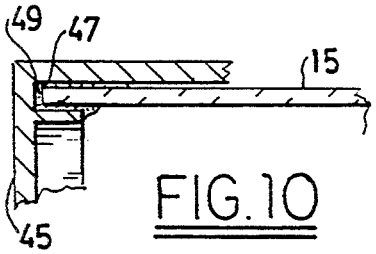
FIGS. 10 and 11 are enlarged views with parts broken away of areas 10—10 and 11—11 of FIG. 7.

An important feature of the novel lighting device is that the area that is gasketed, and potentially subject to leakage, is minimal. Thus, only one end of the housing is removable. The lower end 43 is permanently sealed, preferably, as shown in FIGS. 6 and 7, by a plastic cap 45 which is bonded to the housing 15 with epoxy cement or other water-proof adhesive, or, for example, by thermal fusion to the thermoplastic housing. A detailed view of the preferred bonding of bottom cap 45 to housing 15 is shown in FIG. 10 where epoxy cement 47 fills and permanently seals the groove 49 in cap 45 in which the lower end of housing 15 is fitted. The need for a gasket which can be a potential source of leakage is thus eliminated.

Figure 8:
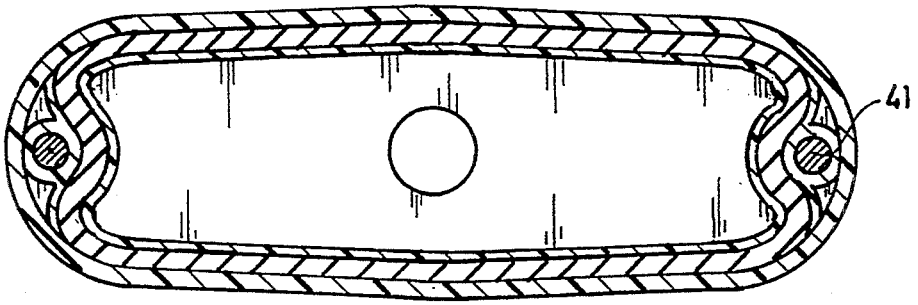
FIGS. 8 and 9 are sectional views along lines 8—8 and 9—9, respectively, of FIG. 7.
Figure 9:
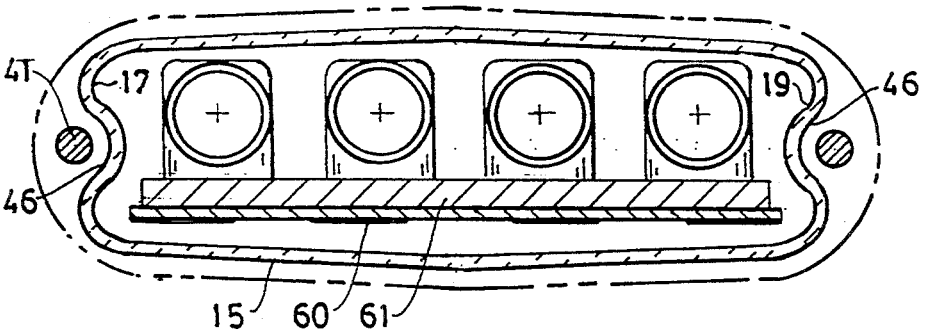

Another feature of the new lighting device that contributes to the combination of water-tight sealing and access to the lighting elements is the positioning of fastening rods 41 outside of the sealed area of housing 15. FIGS. 6, 8 and 9, in particular, show the positioning of rods 41 in the grooves 46 which are formed in the connecting walls 17 and 19 of housing 15. Grooves 46 not only serve as channels for rods 41; they also provide longitudinal strength to the housing and serve as internal positioning guides for the circuit board 60 and weight plate 61. At their lower ends 48, the rods 41 advantageously are permanently fixed to the lower cap 45 of housing 15. Alternatively, they can simply be provided with an enlarged head 50 which engages the area of lower cap 45 surrounding a hole in cap 45 through which the rod passes. At their upper ends, the rods 41 pass through holes in removable upper cap 30 and extend a short distance past the surface of the cap. The upper end of each rod is threaded to a cap nut 51 which can be tightened to force the gasket of upper cap 30 into watertight engagement with the rim of housing 15.

Figure 11:
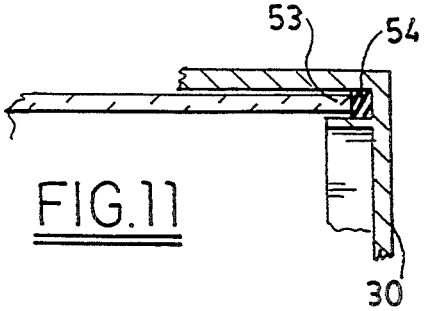

As shown in detail in FIGS. 6 and 11 on the inner surface of upper cap 30 is molded a groove 53. The groove is filled to an appropriate depth with a resilient water-proof gasket material 54 such as rubber, cork or synthetic polymer. This gasket is the principal gasket in the lighting device of the invention, although, desirably, as discussed above, a removable connection attaches the flexible tube 12 to housing 15 and this connection too is gasketed, e.g., by gasket means between nipple 32 and screw fitting 31. Thus, in the device of the invention, lighting elements of relatively large dimensions and of different lengths can be inserted and removed longitudinally from a water-tight housing through an opening of minimal size which requires a minimal gasket area positioned at the point of least hydrostatic pressure.

Although the upper cap 30 can be removably attached to housing 15 by means other than rods 41, for example, by a short threaded post passing through the cap and bonded to housing 15 at its lower end, the rods 41 are preferred and provide an unexpected advantage. They can be formed of a translucent colored plastic which adds an ornamental value to the device. When the device is illuminated these translucent colored rods provide a pleasing appearance.

FIGS. 7 and 9 show a preferred embodiment of the invention in which a weight plate 61 is attached to the circuit board 60. In this embodiment, the metal plate 61 supplies sufficient weight to reduce the buoyancy of device 10 and ensure that it remains in the desired submerged position.

Applicant has described subject matter related to the present invention in a Disclosure Document No. 298173 which was filed in the USPTO on Jan. 6, 1992 and is incorporated herein by reference.

The invention has been described in detail with particular reference to preferred embodiments thereof, but it will be understood that variations and modifications can be effected within the spirit and scope of the invention.

I claim:

1. A water-submersible lighting device comprising:

a waterproof housing in the form of a flattened tube of elongated transverse cross section that is uniform throughout the length thereof; within said housing a plurality of elongated tubular fluorescent lamps positioned lengthwise in the housing in parallel relationship to each other; said housing comprising two substantially parallel face walls of relatively large area, at least one of said face walls being transparent, and two connecting walls of relatively small area, each of said connecting walls being indented to form a groove extending the length of the housing on the outside of each of said connecting walls; said housing further comprising a watertight closed end and an open end having a rim that corresponds to the transverse cross section of said housing at said open end;

a watertight cap positioned on the rim of said housing, said cap being in the form of an inverted cup having a depending circumferential wall of elongated cross section, the inner circumference thereof being sufficiently large to enclose the open end of said housing, within and on the under surface of said cap a continuous channel, resilient gasket material positioned in said channel and coextensive with the rim of said housing;

a connecting rod positioned longitudinally in each said groove, each rod being fixed to the closed end of the housing and being of length sufficient to extend beyond the rim of said housing and through the cap positioned on said rim;

means attached to the end of each said rod the pressing said cap and gasket material into watertight engagement with the rim of said housing, said means being positioned outside of said continuous channel; and a watertight flexible tube sealably attached to an opening in said cap and enclosing an electrical conductor connected at one end to circuitry that drives said fluorescent lamps in said housing and at its other end to a source of low voltage direct current, wherein said tube provides a vent to the atmosphere for said housing.

2. A lighting device of claim 1 further comprising semi-rigid but bendable supporting means enclosed within said flexible tube and extending from about the position of said cap a sufficient distance toward the remote end of said tube to permit bending of said supporting means and said tube into the form of a hook.

3. A lighting device of claim 2 wherein said bendable supporting means is a metal rod.

4. A lighting device of claim 1 further comprising an elongated metal weight plate positioned between said fluorescent lamps and a face wall of said housing.

5. A lighting device of claim 1 wherein said housing is formed of an extruded transparent plastic tube.

6. A lighting device according to claim 1 wherein said cap is opaque.

7. A water-submersible lighting device comprising:

a waterproof housing in the form of a flattened tube of elongated transverse cross section that is uniform throughout the length thereof; within said housing a plurality of elongated tubular fluorescent lamps positioned lengthwise in the housing in parallel relationship to each other; said housing comprising two substantially parallel face walls of relatively large area, at least one of said face walls being transparent, and two connecting walls of relatively small area, each of said connecting walls being indented to form a groove extending the length of the housing on the outside of each of said connecting walls; said housing further comprising a watertight closed end and an open end having a rim that corresponds to the transverse cross section of said housing at said open end;

a watertight cap positioned on the rim of said housing, said cap being in the form of an inverted cup having a depending circumferential wall of elongated cross section, the inner circumference thereof being sufficiently large to enclose the open end of said housing, within and on the under surface of said cap a continuous channel, resilient gasket material positioned in said channel and coextensive with the rim of said housing;

a connecting rod positioned longitudinally in each said groove, each rod being fixed to the closed end of the housing and being of length sufficient to extend beyond the rim of said housing and through the cap positioned on said rim;

means attached to the end of each said rod for pressing said cap and gasket material into watertight engagement with the rim of said housing, said means being positioned outside of said continuous channel; and a watertight flexible tube sealably attached to an opening in said cap and enclosing an electrical conductor connected at one end to circuitry that drives said fluorescent lamps in said housing and at its other end to a source of low voltage direct current.

* * * * *